United States Patent [19]

Bryan

[11] 3,941,489

[45] Mar. 2, 1976

[54] FLAT TOP ONE-HAND CYLINDRICAL LIPSTICK CASE

[75] Inventor: James W. Bryan, Madison, Conn.

[73] Assignee: VCA Corporation, Greenwich, Conn.

[22] Filed: Mar. 22, 1974

[21] Appl. No.: 453,948

[52] U.S. Cl. ..... 401/59
[51] Int. Cl. ..... A45d 40/06
[58] Field of Search ..... 401/59, 60, 107, 108

[56] References Cited

FOREIGN PATENTS OR APPLICATIONS

| | | | |
|---|---|---|---|
| 795,516 | 1/1936 | France | 401/59 |
| 172,357 | 2/1952 | Austria | 401/59 |
| 1,001,240 | 10/1951 | France | 401/59 |
| 999,250 | 10/1951 | France | 401/59 |

*Primary Examiner*—Lawrence Charles
*Attorney, Agent, or Firm*—H. Gibner Lehmann; K. Gibner Lehmann; E. Donald Mays

[57] ABSTRACT

A dispensing holder for cosmetic stick product and the like, comprising an outer casing which is completely cylindrical and has an opening at one end. A circular rim surrounds the opening and has an annular shoulder at its underside. Cooperable with the shoulder is a thin, curved wafer-like closure member disposed in the casing and movable from a retracted position closely underlying the cylindrical casing wall to an advanced position wherein it spans the open end of the casing so as to engage the shoulder and form a tight, dust-proof seal therewith. The circular rim lies in a plane which is substantially perpendicular to the casing axis, such that the casing has the especially pleasing external appearance of a perfect cylinder. The closure member is carried by a flexible, push-pull actuator strap which is guided for movement along diametrically opposite longitudinal portions of the casing by a tubular internal guide member. A product-carrying cup is disposed in the guide member and is movable between advanced and retracted positions respectively, as the closure member is moved between its retracted and advanced positions. A finger piece extends through a longitudinal slot in the casing and is connected to the strap. The closure member is thin and yieldable such that in its retracted position it has a curved cross-sectional configuration which enables it to nest immediately inside the cylindrical casing wall. As the closure member is moved toward its advanced position, it undergoes tilting movement and at the same time flattens somewhat such that when it spans the open end of the casing it has a substantially planar configuration and sealingly engages the circular rim shoulder.

18 Claims, 30 Drawing Figures

13
32
29
48
10
12
6
9
132
134
20
42
14
40
41
28
129
22
18
56
16
8
86
80
92
94
24
103
102
38
130
11

FLAT TOP ONE-HAND CYLINDRICAL LIPSTICK CASE

BACKGROUND

This invention relates generally to cosmetic stick holder and applicator devices such as lipstick cases, and more particularly to devices of this type which employ a flexible strap operator to actuate a movable product-carrying cup.

Prior strap operated lipstick dispensers have been of square or rectangular cross-section wherein the strap or band was fastened at one end to the product-carrying cup and at its other end to a finger piece which extended outwardly through a slot in the wall of the casing. The strip travelled along an internal guide having a 180° bend, such that sliding movement of the finger piece in a direction away from the open end of the casing caused advancement of the cup and stick product whereby the latter would partially protrude through the open casing end. Frequently the free end of the actuator strip was made sufficiently long and wide (just slightly narrower than the width of the rectangular casing) to extend across the casing open end, so as to constitute a closure therefor when the cup was moved to its retracted position.

There were several distinct disadvantages and drawbacks in these outmoded or unsuccessful prior dispensers. In virtually all prior constructions, the cases were difficult to manipulate and use, since they could not be easily twirled in the manner of a cylinder, when in the hand of the user during application. It is well recognized that such rolling or twirling movement is desirable to facilitate the application of lipstick wax, for example.

In addition, many of the prior devices were frequently complex and difficult to assemble. In some instances, the insertion of the strip and cup into the casing was somewhat awkward and as a result, the assembly time often became excessive. Finally, the prior devices were large and cumbersome in a relative sense, and were not in keeping with the aesthetic requirements of this type of cosmetic article. Also, the filling of the product cup with the cosmetic material or lipstick was often difficult, since after assembly the cup was disposed inside the casing and was not always directly accessible for such a filling operation.

SUMMARY

The above drawbacks and disadvantages of prior cosmetic holder devices of the kind indicated are obviated by the present invention, which has for one object the provision of a novel and improved holder and applicator of the flexible push-pull strap type, wherein the casing need not be of square or rectangular cross section but instead has the configuration of a perfect cylinder with a flat-top closure, the latter providing a dust-proof seal of the dispenser contents. The perfectly cylindrical exterior facilitates the twirling or rolling movements found to be desirable by the average user. Also, the cylindrical shape of the casing and a separate circular rim carried thereby makes it possible to stamp or decorate the exterior by means of a hot-roll process. Therefore, different exterior ornamentations can be employed, so as to attract the diverse mass market. A related object of the invention is the provision of a holder-applicator device as above characterized, which has but a single moving part, and which is constituted of a minimum number of separate pieces capable of being molded of plastic in simple mold cavities. Another object is the provision of a cosmetic holder device of the kind indicated, which can be readily assembled with a minimum of time and effort and with virtually no interference between the various parts during assembly. Still another object of the invention is the provision of a cosmetic holder which can be readily filled with cosmetic product in liquid form after the assembly of the dispenser has been completed, wherein such filling is capable of being accomplished in an extremely simple and efficient manner, without spillage, loss or waste of the material. A further object of the invention is to provide a holder and applicator as above set forth with a perfectly cylindrical casing and an interchangeable top or upper ring therefor, thus enabling different ring styles to be employed and different exterior decorations to be roll hot stamped on the casing so as to satisfy the requirements of diverse mass markets. Still another object of the invention is the provision of a dispenser as above characterized which is smooth and reliable in operation, and is virtually maintenance free.

The above objects are accomplished by providing a lipstick holder and applicator which comprises a hollow, essentially cylindrical casing having an opening at one end and a substantially circular rim surrounding the opening, in combination with a unique, thin and flexible, rounded closure member which is movable between an advanced position engaging the rim so as to span the open end of the casing and seal the same, and a retracted position closely underlying the cylindrical casing wall. The device has a product-carrying cup that is movable longitudinally in the casing between advanced and retracted positions, and a very narrow, flexible push-pull actuator strap having one end attached to the cup. Guide means in the casing, including a direction-reversing portion, confine the strap for movement. Because the push-pull strap is very narrow, the casing can be made essentially perfectly cylindrical on the outside. The casing has a longitudinal slot which guides a finger piece, the latter being attached to the push-pull strap at a point thereon adjacent the closure member. The arrangement is such that the closure member can move along the inside surface of the casing, from a retracted position intermediate the casing ends to an advanced, tilted position wherein it extends across and closes the open end of the casing in response to sliding of the finger piece along the casing slot in a given direction. By virtue of the closure member being thin and flexible, it can assume a curved, concavo-convex configuration closely underlying the casing wall when in its retracted position, and a substantially flat, planar configuration when moved to its advanced position engaging the rim of the casing, to thereby provide a tight, dust-proof seal of the casing and prevent contamination of the stick product therein.

Other features and advantages will hereinafter appear.

In the drawings, illustrating a preferred embodiment of the invention:

Figures 1, 2, 3, 4, 5, 6, 7:
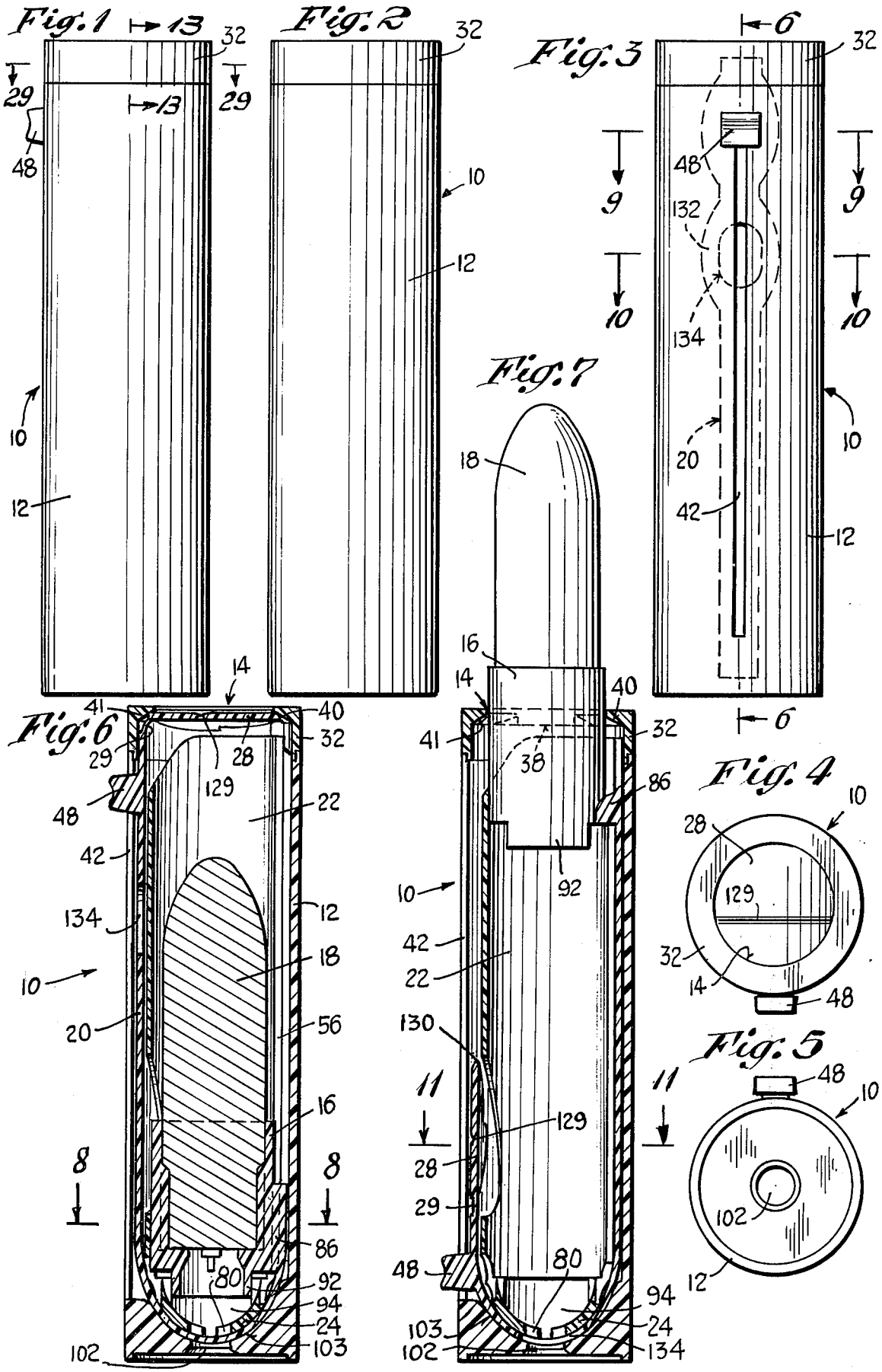
FIG. 1 is a side elevational view of the cylindrical, flat top cosmetic holder and dispenser of the present invention, comprising a casing having an internal guide member and a closure member, with the latter being shown in the fully closed, sealing position.
FIG. 2 is a front elevational view of the holder and dispenser of FIG. 1.
FIG. 3 is a rear elevational view of the holder and dispenser of FIGS. 1 and 2.
FIG. 4 is a top plan view of the holder and dispenser of FIGS. 1–3.
FIG. 5 is a bottom plan view of the holder and dispenser.
FIG. 6 is a vertical section taken on line 6—6 of FIG. 3.
FIG. 7 is a vertical section of the holder and dispenser of FIGS. 1–6, showing the dispenser in its open condition and illustrating a product cup carried therein and disposed in the fully advanced position.

FIGS. 1–7 illustrate a cosmetic stick dispenser and holder generally designated by the numeral 10, comprising an essentially circular or cylindrical outer casing 12 having an opening 14 at one end, and a strap operated product-carrying cup 16 disposed in the casing and longitudinally movable therein between advanced and retracted positions illustrated respectively in FIG. 7 and FIG. 6. The cup carries a lipstick or other cosmetic stick 18 as shown. Attached to the cup 16 is one end of a push-pull actuator strap 20 which is flexible and capable of bending as it moves within the casing. The strap is guided and confined by an internal guide member 22 which has a 180° reversing guide portion 24. The guide member is illustrated particularly in FIGS. 15–19.

Figure 8:
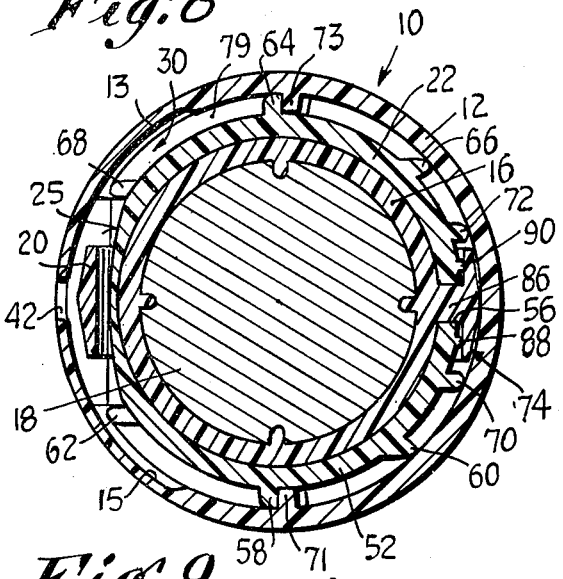
FIG. 8 is a section taken on line 8—8 of FIG. 6.
Figure 11:
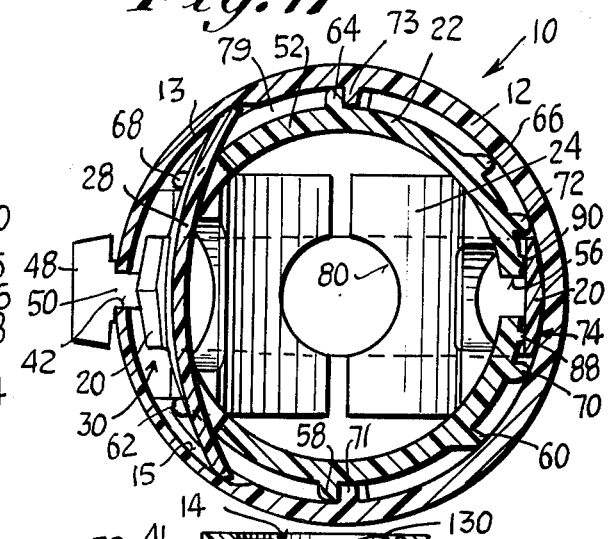
FIG. 11 is a section taken on line 11—11 of FIG. 7.
Figure 9:
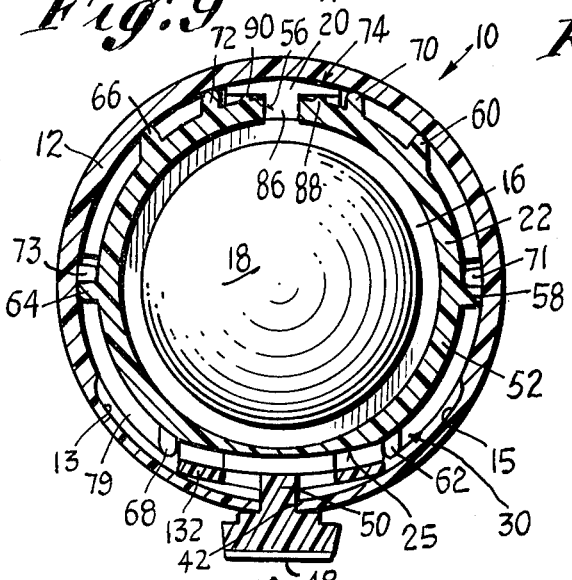
FIG. 9 is a section taken on line 9—9 of FIG. 3.
Figure 10:
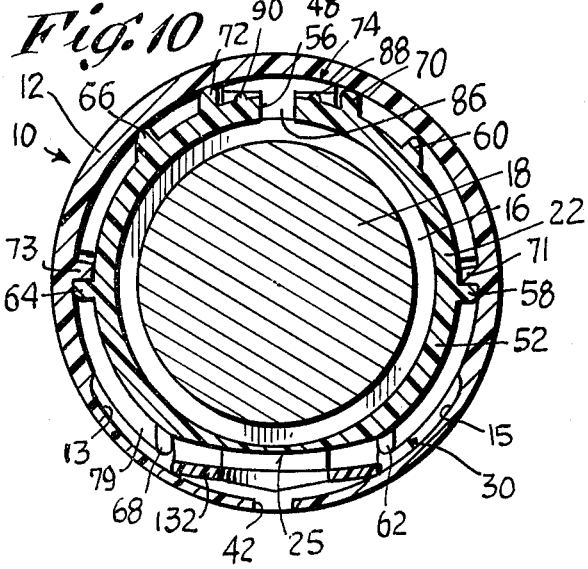
FIG. 10 is a section taken on line 10—10 of FIG. 3.
Figure 13:
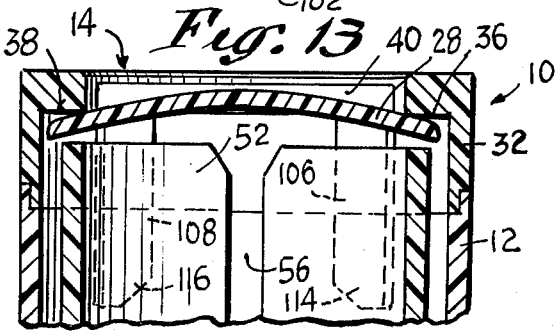
FIG. 13 is a section taken on line 13—13 of FIG. 1.
Figure 14:
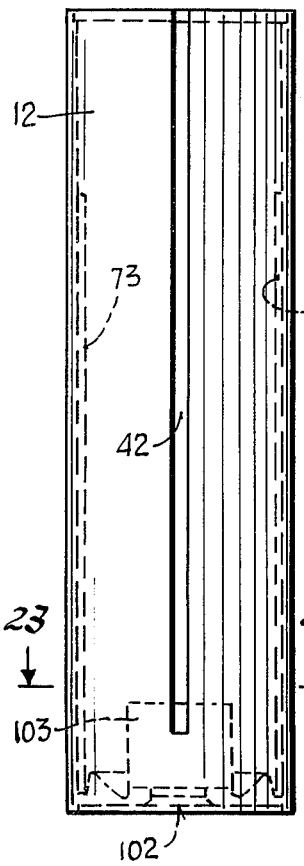
FIG. 14 is a rear elevational view of the casing portion per se of the holder and dispenser of FIGS. 1–13.
Figure 15:
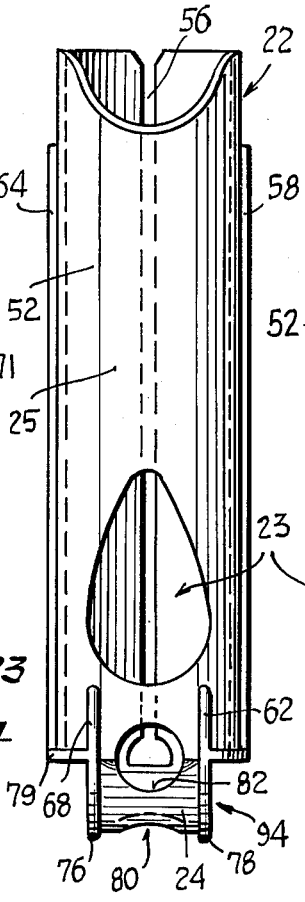
FIG. 15 is a rear elevational view of the internal guide member per se of the holder and dispenser of FIGS. 1–13.
Figure 16:
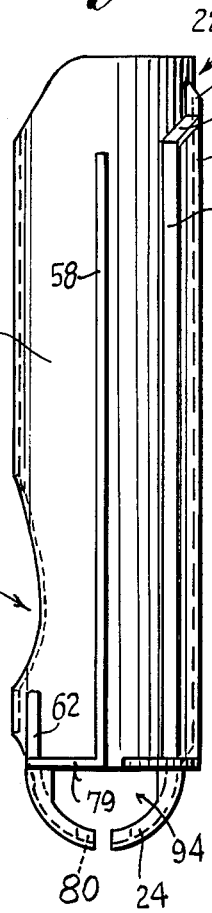
FIG. 16 is a side elevational view of the internal guide member of FIG. 15.

Referring to FIGS. 6 and 7 and in accordance with the present invention there is provided a thin and flexible, wafer-like closure member 28 of generally curved configuration carried on the other end of the strap 20, and a substantially circular rim 32 disposed on the open end of the casing 12. The closure member 28 is movable between an advanced or sealing position (FIG. 6) wherein it spans the top or opening of the casing, and a retracted position (FIG. 7) wherein it partially fills a curved space between the outer casing 12 and the internal guide member 22. The curved space is designated by the numeral 30 in FIGS. 8–10, and in FIG. 11 the closure member 28 is shown occupying this curved space. A resilient, bendable hinge 29 connects the strap 20 and member 28, enabling limited flexing movement between the two parts.

Figure 12:
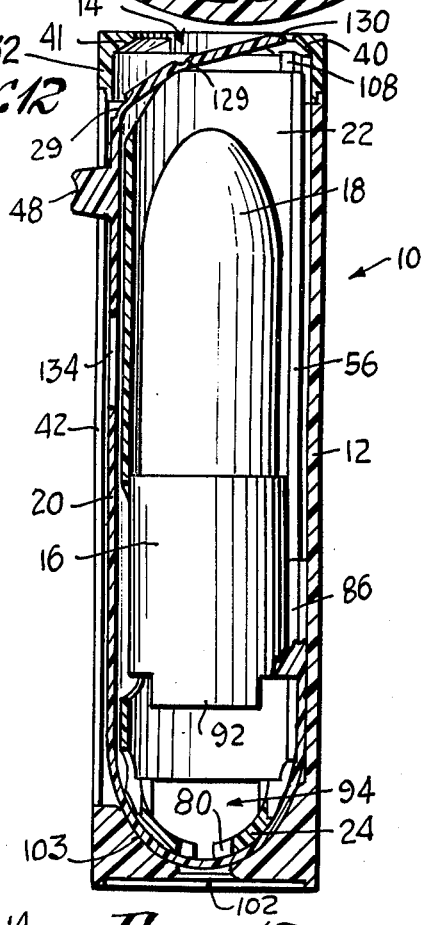
FIG. 12 is a view like FIG. 6, except illustrating the closure member in an intermediate position just prior to its being advanced to the fully closed, sealing position.
Figures 20, 21, 22, 23, 24, 25, 26, 27, 28, 29, 30:
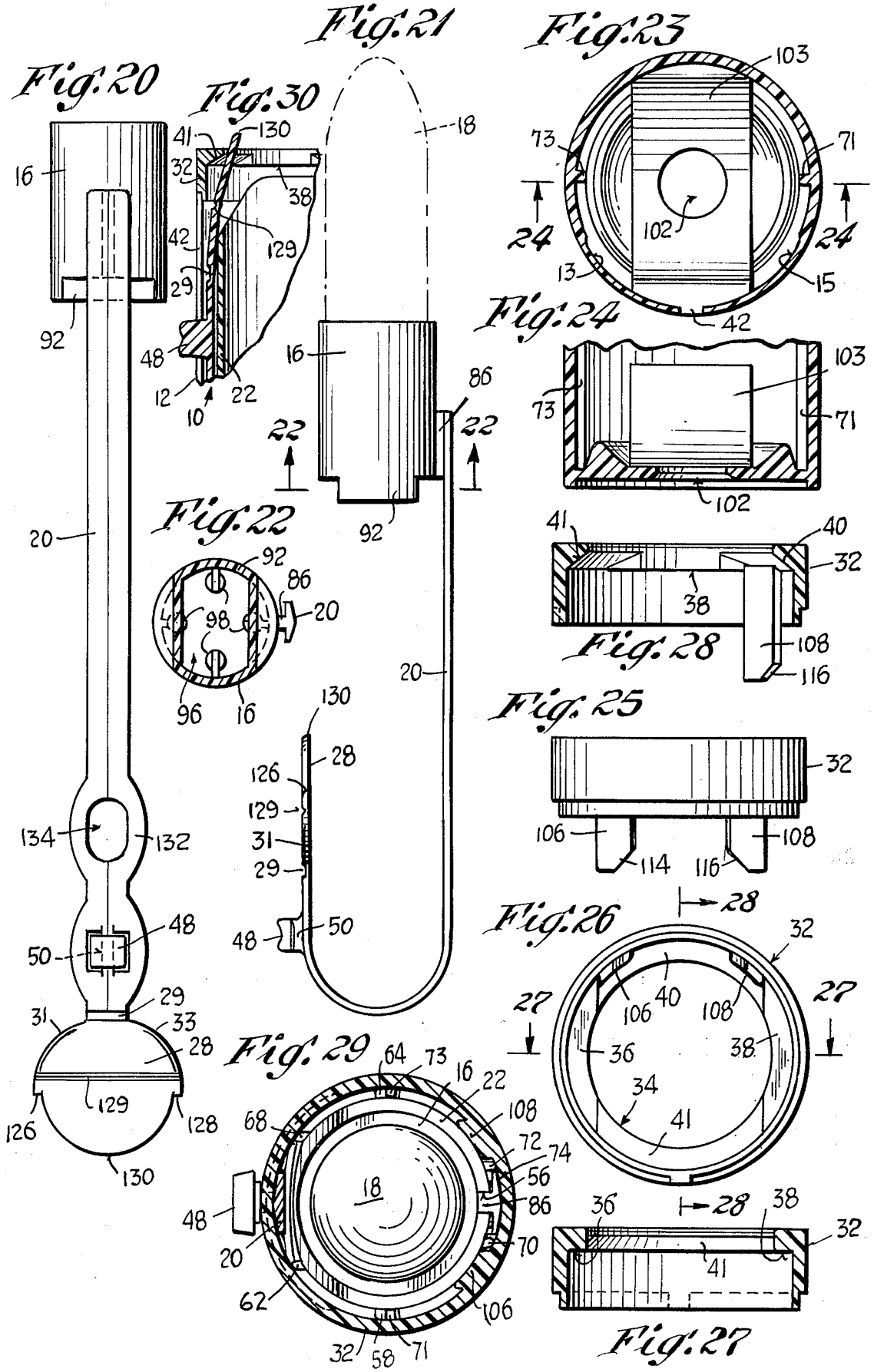
FIG. 20 is a front elevational view of a one-piece push-pull actuator strap and product carrier cup carried thereby as employed in the dispenser of the present invention.
FIG. 21 is a side elevational view of the strap and cup of FIG. 20, wherein the strap has been bent to simulate its position during movement inside the casing of the dispenser.
FIG. 22 is a section taken on line 22—22 of FIG. 21.
FIG. 23 is a section taken on line 23—23 of FIG. 14.
FIG. 24 is a section taken on line 24—24 of FIG. 23.
FIG. 25 is a front elevational view of the rim portion of the casing of FIG. 1, the rim portion being constituted as a separate piece.
FIG. 26 is a bottom plan view of the rim portion illustrated in FIG. 25.
FIG. 27 is a section taken on line 27—27 of FIG. 26.
FIG. 28 is a section taken on line 28—28 of FIG. 26.
FIG. 29 is a section taken on line 29—29 of FIG. 1.
FIG. 30 is a fragmentary view of the top of the dispenser illustrating the closure member in an intermediate position wherein the leading edge of the member is just beginning to engage part of the underside of the circular rim and undergoing slight tilting movement in response to such engagement.

As shown in FIGS. 1 and 2, the rim 32 is annular and generally lies in a plane perpendicular to the axis of the casing 12. The rim is illustrated as being constituted of a separate piece, particularly illustrated in FIGS. 25–28, the piece being assembled to the casing after insertion of the internal guide member 22 and the strap-cup assembly shown in FIG. 21. FIG. 26 shows an annular shoulder 34 on the underside of the rim, comprising a pair of oppositely disposed shelves 36, 38, which are both co-planar and coextensive with one another, and comprising a pair of sloped surfaces 40, 41 one of which (41) constitutes a camming surface for effecting initial tilting movement of the closure member 28 as it is moved from its retracted position toward its advanced position (from position of FIG. 7 toward position of FIG. 12). The shelves 36, 38 engage a pair of oppositely disposed abutment surfaces on the closure member to effect further tilting movement of the latter after it has passed the camming surface 41.

Referring to FIGS. 3, 6, 7 and 14, the casing 12 is seen to be elongate and has a longitudinal slot 42 extending substantially along its entire length and being of generally uniform width. The actuator strap 20 has a finger piece 48 which extends through the casing slot and is externally engageable by the fingers of the user to effect advancing and retracting movement of the product cup and simultaneous actuation of the closure member 28. The finger piece 48 is attached to the strap by a bridge 50 (FIGS. 20, 21).

Referring now particularly to FIGS. 15–19, the internal guide member 22 is elongate and comprises an annular wall portion 52 extending substantially for 360°, and a direction-reversing guide portion 24 disposed near one end. The guide member 22 has a longitudinal slot 56 extending substantially the entire length thereof. The annular wall 52 has a series of longitudinal positioning ribs 58, 60, 62, 64 and 66, 68, on its exterior surface which are adapted to engage the inside wall of the outer casing, and thus space the internal guide member therefrom, the ribs tending to maintain it in a centralized position. Also disposed on the exterior surface of the guide member is a pair of longitudinal guide ribs 70, 72 extending substantially parallel to the slot 56 and disposed on opposite sides thereof. The ribs 70, 72 together with the annular wall 52 on either side of the slot 56, and the inner surface of the casing 12, define a channel 74 (FIG. 11) to closely confine a portion of the strap along its path of movement. The guide ribs 70, 72 also serve to help maintain the internal guide member centralized with respect to the casing 12.

FIGS. 8–11 and 14 illustrate two elongate positioning ribs 71, 73 on the inner surface of the outer casing 12 which also extend substantially the entire length thereof. The ribs 71, 73 are adapted to engage the external ribs 58, 64 respectively on guide member 22 to thereby maintain the latter in a fixed position in the casing and prevent relative rotation with respect thereto.

FIGS. 15–19 also show the details of the direction-reversing guide portion 24. This guide portion is curved as shown, extends through an arc of 180°, and has a pair of spaced-apart flanges 76, 78 which provide centralization for a particular portion of the actuator strap to be described later. The guide has a hole 80 at its center, the center of the hole being substantially in alignment with the major axis of the guide member. This hole facilitates filling of the product cup from the bottom of the dispenser after the latter has been fully assembled. The additional holes 82, 84 result from the molding of the guide member.

Referring now to FIGS. 6, 7, 12 and 21, it can be seen that the actuator strap is fastened to the product cup 16 by means of a bridge 86. Preferably, the product cup 16, actuator strap 20, finger piece 48 and closure member 28 are molded as a single, integral piece as in FIGS. 20, 21. The bridge 86 is adapted to be received in the slot 56 of the internal guide member (from the open end thereof), such that the product cup 16 can freely slide longitudinally therein. To minimize friction and eliminate any tendency toward bending of the strap and cup, there is provided on the exterior surface of the guide member a pair of longitudinal bearing slide ribs 88, 90 disposed closely adjacent and on opposite sides of the slot 56. These engage the strap at only limited points and thus minimize the contact area between it and the guide member.

Referring again to FIGS. 20–22, the product cup has a rectangular portion 92 at the periphery of its bottom, which is adapted to be extended partially past the area of the annular wall adjacent the annular bead 79 and into the hollow space 94 inside the direction-reversing guide. This arrangement permits the cup, when in its retracted position, to be as close to the bottom end of the casing as possible, thus minimizing the required overall length of the casing. The cup also has a hole 96 in its bottom which enables it to be filled by means of a long tube extending therethrough and through the bottom of the casing after the latter has been completely assembled. A series of projections 98 extending into the interior of the cup are adapted to secure a solidified cosmetic stick after it has been injected into the cup in liquid form and allowed to harden.

The bottom wall of the casing 12 has a small hole 102 (FIG. 5) which facilitates filling of the product cup 16 after the dispenser is completely assembled. As shown in FIGS. 6, 7, 12 and 14, the interior surface of this bottom wall has a curved reversing track 103 adapted to engage and confine intermediate portions of the actuator strap 20 as it moves along the direction-reversing guide portion 24 (FIGS. 6, 7).

Figure 17:
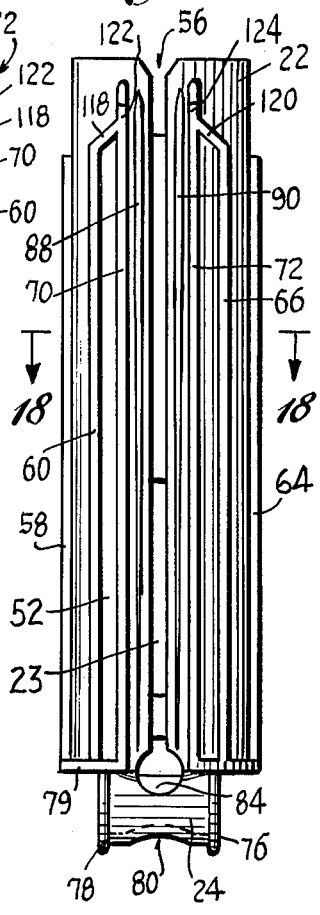
FIG. 17 is a front elevational view of the internal guide member of FIGS. 15 and 16.

The above construction is extremely well adapted for maximum ease of assembly and minimum assembly time. Referring to FIGS. 20 and 17, the product cup 16 is first inserted into the open end of the guide member 22 such that the bridge 86 is received in the slot 56, with the actuator strap 20 extending toward the direction-reversing guide portion 24. The strap 20 is then bent around the reversing guide portion and the closure member swung to a position adjacent the guide member annular wall 52 diametrically opposite the location of the slot 56. This assembly is then inserted into the casing 12 through the open top end thereof with the separate rim piece removed, such that the bridge 50 of the finger piece 48 is received in the outer casing slot 42, and the ribs 58, 64 of the internal guide member 22 engage the ribs 71, 73 on the inner surface of the casing 12. The relative positions of the ribs for the assembled condition of the dispenser are shown in FIGS. 8–11.

Referring to FIGS. 25–28 and in accordance with the present invention the circular rim piece 32 has a pair of depending lugs 106, 108 which lie along a radius slightly smaller than the inside radius of the outer casing, such that they can be received therein when the rim is assembled to the top of the casing as in FIGS. 1–3, 6, 7, or 12. As shown in FIGS. 29, these lugs occupy a portion of the annular space between the internal guide member 22 and the casing 12. The top end of the casing has an internal annular shoulder 110 which is engaged by and constitutes a seat for a cooperable external shoulder 112 on the rim when the two pieces are assembled together.

Referring now particularly to FIGS. 17 and 25–26, the lugs 106, 108 have tapered end portions 114, 116, respectively. These end portions respectively engage a pair of oblique ribs 118, 120 on the internal guide member 22 so as to retain the latter in a fully seated position in the casing following assembly. In addition, the lugs 106, 108 also engage the end portions 122, 124 of the ribs 70, 72 (FIG. 17) to prevent looseness between the guide member 22 in the casing 12. Following assembly of the dispenser, the rim piece 34 is held in place on the casing by means of a sonic-weld, cement or the like.

In operation, the product cup 16 is movable between an advanced position illustrated in FIG. 7 and a retracted position illustrated in FIG. 6, by means of the strap 20, which is in turn actuated by the finger piece 48. It will be understood that as this is done, the end portions of the strap 20 move in opposite but substantially parallel directions, with the intermediate portion of the strap extending through a bend of approximately 180 degrees as it traverses the reversing guide portion 24. During its movement along the reversing guide, the strap is confined by the same and by the hollow, inner surface 104 of the casing bottom. By the above arrangement, an especially convenient, smooth, one-hand operation is achieved, with a perfectly cylindrical lipstick casing.

Figure 18:
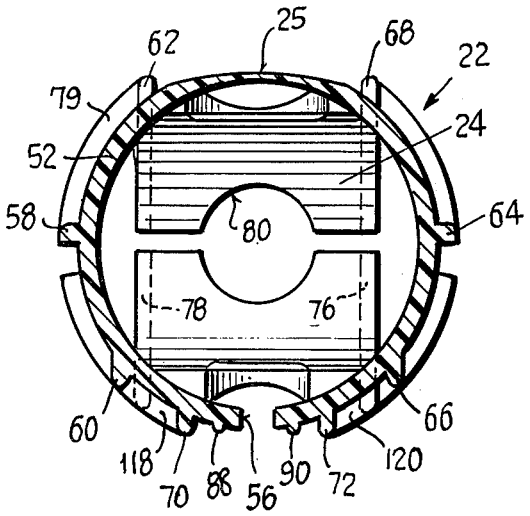
FIG. 18 is a section taken on line 18—18 of FIG. 17.
Figure 19:
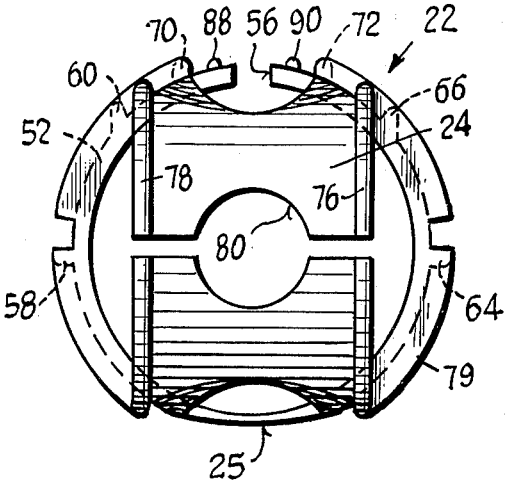
FIG. 19 is a bottom plan view of the internal guide member of FIGS. 15–17.

In order to insure smooth operation, I have found that it is desirable to maintain as small as possible the required curvature of the closure member 28 when the latter occupies its retracted position (FIG. 7). In accomplishing this, the internal guide member 22 is provided with a relief aperture 23 (FIGS. 15 and 16) which can receive broadside the center portion of the closure member in its fully retracted position. The aperture is sufficiently large to enable the closure member to have a somewhat flattened configuration, but small enough so as not to interfere with its sliding movement. Such an arrangement prevents the member from taking a hard "set", and thus facilitates its virtually complete flattening as it assumes the fully advanced position. In addition, the inner surface of the casing has relieved portions 13, 15 extending about 60° on either side of the slot 42 (FIGS. 8–11 and 14). Also, the outer surface of the internal guide member 22 has a relieved or flatted portion 25 (FIGS. 18, 19). These relieved surfaces reduce the required curvature of the closure member as it is moving along the casing wall and thus provide smoother operation when the member is required to flatten from its concavo-convex shape.

FIG. 20 shows bevelled edges 31, 33 on the closure member adjacent the location of the hinge 29. These edges can flex somewhat when the closure member is being retracted. Thus, any tendency for the latter to become caught on the rim of the internal guide member during retraction is greatly minimized.

It is to be noted that the closure member 28 is molded as a flat piece and has a generally circular outline. By the present invention a portion of the periphery is relieved, providing a pair of abutment shoulders 126, 128. These shoulders engage a portion of the rim as will be explained below to effect tilting of the closure member as it is moved from a retracted position toward its advanced position spanning the open end of the casing. Also in accordance with the present invention the closure member has a hinge or a bending line of weakness 129 extending substantially the full width of the member and having its end portions adjacent the shoulders 126, 128. The hinge 129 thus separates the member into two parts, and enables easy relative bending movement of these two parts with respect to one another as the member moves from its retracted position toward its advanced position. Such bending movement is shown particularly in FIG. 12 and facilitates smooth sliding movement of the closure member to its fully advanced position spanning the open end of the casing.

As shown in FIGS. 8–13, the member 28 is flexible, and can assume a concavo-convex shape when disposed in its retracted position (FIG. 7) to occupy a portion of the annular space 30 between the casing 12 and internal guide member 22. From the position of FIG. 7, as the member is moved toward its advanced position, the leading edge 130 of the closure member first engages the camming surface 41 of the shoulder on the rim piece (FIG. 26). Such engagement initiates the first tilting movement of the member which still has a concavo-convex configuration for this position. The above mentioned bending movement of the parts of the closure will now commence. After the leading edge passes this surface 41, the shoulders 126, 128 on opposite sides of the closure member 28 engage the shelves 36, 38 respectively and slide therealong for a short distance (toward the right in FIG. 12). The closure members now begins to flatten somewhat, due to its resilience and due to the fact that it is no longer confined in the curved annular space 30 between the internal guide member 22 and the casing 12. Continued actuation of the finger piece in an upward direction causes further tilting of the closure member until it reaches the position of FIG. 6. The abutment shoulders 126, 128 remain engaged with the shelves to prevent the closure member from extending outward through the opening in the rim. For the fully advanced position, the leading edge 130 engages the oppositely disposed camming surface 40 which guides it in a slightly downward direction in FIG. 6 such that the closure member lies essentially in a horizontal plane perpendicular to the axis of the casing. For this position, the closure member is only slightly concavo-convex, or essentially flat. In the working model which has been constructed, the member retains a slightly curved cross sectional configuration.

In accomplishing a bottom fill of the assembled container, the actuator strap 20 is provided with an offset portion 132 in the form of an enlargement with an opening 134. It will be understood that the actuator strap 20 can be moved to a position wherein the opening 134 is in exact alignment with the hole 80 in the reversing guide portion 24, and with the hole 102 in the bottom of the dispenser. The spaced apart flanges 76, 78 of the direction-reversing guide portion 24 centralize the opening 134 of the strap with respect to the hole 80 in the reversing guide portion. This "fill" position would be identical to the fully advanced position (FIG. 7) of the product cup of the dispenser. Note that for this condition, part of the product cup 16 extends beyond the rim 32 such that a molding cap can be temporarily applied thereto. Suitable filling apparatus (not shown) then applies liquid product from a tube inserted through the holes in the closure plug, strap, and guide member reversing guide portion, and through the opening or hole 96 in the bottom of the product cup 16. Following completion of the filling, the tube is withdrawn. Upon solidification of the cosmetic stick, the cap is removed from the cup 16, and the latter fully retracted to the position of FIG. 6, which is suitable for storage, shipping or display, etc.

It will be noted in FIGS. 20–22 that the strap 20 has an opening immediately adjacent the finger piece 48. This results from molding, and enables the cup, strap, and finger piece to be constituted as a single piece.

The above construction is seen to have a number of distinct advantages. The dispenser consists essentially of four separate parts which can be easily and economically molded in simple mold cavities. The unique arrangement of the flexible closure member and circular rim enable the realization of a perfectly cylindrical casing having a strictly flat-top configuration. The dispenser operates smoothly and is easy and convenient to use.

Assembly of the dispenser is greatly facilitated due to the special configuration of the internal guide member, in combination with an outer casing which is adapted to receive the guide member from its top end. By virtue of the longitudinal bearing slide ribs 88, 90 on the outer surface of the guide member, an especially friction-free and smooth advancing movement of the product cup is realized. I have found that this arrangement is not at all susceptable to binding or seizing, and thus the reliability of the dispenser under adverse conditions of use has been found to be exceptional. In addition, the capability of filling the assembled dispenser through the one end greatly minimizes the time required and results in a minimum spillage or waste of stick product.

From the foregoing it can be seen that I have provided a novel and improved lipstick dispenser which is extremely simple in construction and economical to manufacture, while providing highly reliable performance. The dispenser is thus seen to represent a distinct advance and improvement in cosmetic stick dispenser technology.

Variations and modifications are possible without departing from the spirit of the invention.

I claim:

1. A dispensing holder for lipsticks and the like, comprising, in combination:

a. a substantially cylindrical casing having an open top end which is substantially perpendicular to the longitudinal axis of the casing, b. an elongate, hollow, cylindrical, internal guide member received in said casing, said guide member having a smaller outside diameter than the inside diameter of said casing thereby providing an annular space therebetween, c. a substantially circular, thin, wafer-like closure member disposed in said annular space and adapted to span the open end of said casing, d. a flexible push-pull strap connected to said closure member and having an exposed finger piece, e. cooperating guide means on said casing and said guide member to guide said strap and closure member for movement between a retracted position wherein said closure member is removed from said open end and is received in an enlarged portion provided in said annular space thereby permitting said closure member to expand radially to assume a decreased concavo-convex shape in the direction of the longitudinal axis of said casing and said guide member, and an advanced position wherein the closure member spans the open casing top end in a plane substantially perpendicular to the longitudinal axis of said casing and closes said open top end, f. said open top end of the casing having a substantially circular, inwardly extending rim provided with an annular shoulder at its underside, and g. said closure member being concavo-convex in the direction of the longitudinal axis of the casing and guide member in its retracted position, and substantially less concavo-convex in its advanced position so as to closely fit against said shoulder and constitute a tight seal therewith.

2. The invention as set forth in claim 1, and further including:

a. cooperable guide means on the shoulder of the rim and on the closure member for guiding the latter to effect tilting movement thereof as it is shifted from an intermediate position to its fully advanced position.

3. The invention as set forth in claim 1, wherein:

a. said cooperable guide means includes a pair of oppositely disposed shelves on said annular shoulder, b. said closure member having oppositely disposed abutment surfaces engageable with said shelves for effecting said tilting movement as the member is moved from an intermediate position to its fully advanced position.

4. The invention as set forth in claim 3, wherein:

a. said shelves are coextensive and coplanar with one another.

5. The invention as set forth in claim 2, wherein:

a. said cooperable guide means includes a camming portion on said annular shoulder for effecting initial tilting movement of the closure member as it moves from an intermediate position to its fully advanced position, spanning the open end.

6. The invention as set forth in claim 3, wherein:

a. said shelves are coextensive and coplanar with one another, b. said guide means includes a camming portion on said annular shoulder for effecting initial tilting movement of the closure member as it moves from an intermediate position to its fully advanced position, spanning the open end, c. said camming portion being adjacent to but displaced circumferentially from said shelves.

7. The invention as set forth in claim 2, wherein:

a. said cooperable guide means comprises a pair of oppositely disposed shelves on said annular shoulder, b. said shoulder further having a pair of oppositely disposed sloped surfaces circumferentially spaced from the locations of said shelves, c. one of said sloped surfaces constituting a camming portion engageable with the closure member for effecting tilting movement thereof as the latter is moved from an intermediate position to its fully advanced position.

8. The invention as set forth in claim 1, wherein:

a. said casing has an annular wall, b. said circular rim being constituted as a separate piece adapted to be received in abutting relation by the open top end of the casing wall, whereby there is maintained access to the casing interior through the open top to enable insertion of the closure member and strap therethrough during assembly, said separate piece being applied after said insertion.

9. The invention as set forth in claim 8, and further including:

a. said guide member having an annular wall with a positioning rib thereon, and b. said circular rim having projecting means engageable with said positioning rib to hold captive the guide member and prevent turning movement thereof with respect to the casing and rim.

10. The invention as set forth in claim 9, wherein:

a. said positioning rib being disposed on the exterior surface of the guide member wall and extending into said annular space, and b. said projecting means comprising a lug depending from said rim and receivable in said annular space for engaging said rib.

11. The invention as defined in claim 8, wherein:

a. said annular wall of the casing has an annular shoulder adjacent the casing open end, and b. a cooperable shoulder on the separate rim piece, engageable with and adapted to abut the casing shoulder, the latter constituting a seat to position and retain the piece on the casing.

12. The invention as set forth in claim 1, and further including:

a. said guide member providing a channel for confining portions of said actuator strap along its path of movement.

b. said guide member having a direction-reversing guide at its end opposite the location of the rim, and c. said casing having a bottom disk portion with a sloping surface for engaging said strap in the vicinity of said direction-reversing guide, to thereby direct the movement of the strap around the latter.

13. The invention as set forth in claim 1, wherein:

a. said closure member has a part of its periphery relieved to thereby form at least one abutment shoulder, b. said abutment shoulder engaging a portion of the rim for effecting tilting of the closure member as it moves from an intermediate position to a fully advanced position.

14. The invention as defined in claim 1, wherein:

a. said closure member has a part of its periphery relieved to thereby form two abutment shoulders, b. said abutment shoulders engaging a portion of the rim for effecting tilting of the closure member as it moves from an intermediate position to a fully advanced position.

15. The invention as defined in claim 1 wherein:

a. said closure member is flexible and has a curved cross sectional configuration with a radius of curvature larger than the radius of curvature of said casing when disposed in its retracted position and a substantially flat configuration when in its fully advanced position spanning the open end of the casing.

16. The invention as defined in claim 1, and further including:

a. said casing having an annular wall, and b. said enlarged portion in said annular space being provided by the inner surface of said casing wall and the outer surface of said guide member having relieved portions respectively, enabling the closure member to maintain a somewhat flattened configuration when in its retracted position.

17. The invention as defined in claim 1, and further including:

a. said guide member having an annular wall portion, and b. said wall portion having an oval aperture constituting a relief area to receive part of the closure member so as to enable it to flatten somewhat from its concavo-convex shape when it is disposed in its retracted position.

18. The invention as defined in claim 1, wherein:

a. said closure member has a bending line of weakness constituting a hinge extending substantially across its width, enabling different parts of the member to undergo limited bending movement as it travels from an intermediate position toward the fully advanced position.

* * * * *